United States Patent [19]

Butler

[11] Patent Number: 5,053,822

[45] Date of Patent: Oct. 1, 1991

[54] DENSITOMETER FOR MEASURING MARKING PARTICLE DENSITY ON A PHOTORECEPTOR HAVING A COMPENSATION RATIO WHICH ADJUSTS FOR CHANGING ENVIRONMENTAL CONDITIONS AND VARIABILITY BETWEEN MACHINES

[75] Inventor: Michael A. Butler, Rochester, N.Y.

[73] Assignee: Xerox Corporation, Stamford, Conn.

[21] Appl. No.: 632,885

[22] Filed: Dec. 24, 1990

[51] Int. Cl.[5] ..... G03G 15/08

[52] U.S. Cl. ..... 355/246; 356/446; 250/358.1; 250/341; 355/203

[58] Field of Search ..... 355/203, 208, 246; 356/445, 446; 250/341, 358.1; 118/688-691

[56] References Cited

U.S. PATENT DOCUMENTS

| | | | |
|---|---|---|---|
| 4,226,541 | 10/1980 | Tisue | 356/446 |
| 4,313,671 | 2/1982 | Kuru | 355/214 |
| 4,318,610 | 3/1982 | Grace | 355/246 |
| 4,462,680 | 7/1984 | Ikeda | 355/246 |
| 4,502,778 | 3/1985 | Dodge et al. | 355/206 |
| 4,553,033 | 11/1985 | Hubble, III et al. | 250/353 |
| 4,676,653 | 6/1987 | Strohmeier et al. | 356/446 |
| 4,677,298 | 6/1987 | Zelmanovic et al. | 250/341 |
| 4,801,980 | 1/1989 | Arai et al. | 355/206 |
| 4,950,905 | 8/1990 | Butler et al. | 250/358 |
| 4,989,985 | 2/1991 | Hubble, III et al. | 356/445 |

OTHER PUBLICATIONS

Copending U.S. patent application Ser. No. 07/399,051, filed 8/25/89, titled "Densitometer for Measuring Developability".

*Primary Examiner*—Joan H. Pendegrass

[57] ABSTRACT

An electrographic apparatus having a densitometer, which achieves improved measuring of marking particle density on a photoreceptor or the like. The measuring method detects both specular and diffuse light reflected off of the photoreceptor containing marking particles. A compensation ratio is generated from a high density marking particle patch, and is used to compensate the marking particle density to both changing environmental conditions and differences between individual machines. Thus, a more accurate specular signal is calculated which is an accurate indicator of toner density of mass per unit of area concentration. These concentration measures enable accurate adjustments of the electrographic apparatus color toner development systems.

19 Claims, 5 Drawing Sheets

DENSITOMETER FOR MEASURING MARKING PARTICLE DENSITY ON A PHOTORECEPTOR HAVING A COMPENSATION RATIO WHICH ADJUSTS FOR CHANGING ENVIRONMENTAL CONDITIONS AND VARIABILITY BETWEEN MACHINES

BACKGROUND OF THE INVENTION

1. Field of the Invention

The present invention relates generally to an electrophotographic apparatus; and more specifically, to an improved structural arrangement having a densitometer. Moreover, the densitometer arrangement achieves improved measuring of marking particle density on a substrate. Specifically, the densitometer is responsive to both changing environmental conditions and differences between individual machines.

2. Description of the Prior Art

It is known in the electrical graphic arts to use light sensors for measuring the density of a powderous substance or the like. One such sensor is a developability sensor, also known as a densitometer, used to monitor the "Developed toner Mass per unit of Area," referred to as DMA. Current developability sensors are optically based. The sensors are required to monitor the DMA of both black and colored toners. For example, in co-pending U.S. patent application Ser. No. 07/399,051, it describes a densitometer which measures the reduction in the specular component of the reflectivity of a portion of a surface having a liquid color material deposited thereon. Collimated light rays, in the visible spectrum, are projected onto the portion of the surface having the liquid thereon. The light rays reflected from the portion of the surface having the liquid deposited thereon are collected and directed onto a photodiode array. The photodiode array generates electrical signals proportional to the total flux and the diffuse component of the total flux of the reflected light rays. Circuitry compares the electrical signals and determines the difference therebetween to generate an electrical signal proportional to the specular component of the total flux of the reflected light rays.

Similarly, co-pending U.S. patent application Ser. No. 07/246,242, which is herein incorporated by reference in its entirety, describes an infrared densitometer which measures the reduction in the specular component of reflectivity as toner particles are progressively deposited on a moving photoconductive belt. Collimated light rays are projected onto the toner particles. The light rays reflected from at least the toner particles are collected and directed onto a photodiode array. The photodiode array generates electrical signals proportional to the total flux and the diffuse component of the total flux of the reflected light rays. Circuitry compares the electrical signals and determines the difference therebetween to generate an electrical signal proportional to the specular component of the total flux of the reflected light rays.

U.S. Pat. No. 4,950,905, which is herein incorporated by reference in its entirety, discloses a color toner density sensor. Where, light is reflected from a toner predominantly by either scattering or multiple reflections to produce a significant component of diffusely reflected light. Moreover, part of the sensor is arranged to detect only diffusely reflected light, and another part is arranged to detect both diffuse and specularly reflected light. In operation, the diffusely reflected light signals are used to identify increasing levels of diffusely reflected light which in turn indicates an increased density of toner coverage per unit of area.

U.S. Pat. No. 4,801,980, discloses a toner density control apparatus having a correction process. The object of the invention is to prevent a decrease in the image density even when the toner density sensor is contaminated with the toner particles. This is achieved by detecting the degree of contamination and thereby adjusting the light intensity of the reflective LED (light emitting diode) light source accordingly.

U.S. Pat. No. 4,676,653, discloses a method for calibrating the light detecting measuring apparatus and eliminating errors of measurement caused by variations of the emitter or of other electronic components. This is accomplished by using one light transmitter and two detectors. A first detector measures light that is diffusely reflected off of a sample. A second detector measures light that is emitted from the light transmitter. The second detector information is used to calibrate the apparatus and to eliminate errors of measurement caused by variations in the transmitter or other electronic components.

U.S. Pat. No. 4,553,033, describes an infrared densitometer which measures the reduction in the specular component of reflectivity as toner particles are progressively deposited on a moving photoconductive belt. Collimated light rays are projected onto the toner particles. The light rays reflected are collected and directed onto a photodiode array. The photodiode array generates electrical signals proportional to the total flux and the diffuse component of the total flux of the reflected light rays. Circuitry compares the electrical signals and determines the difference therebetween to generate an electrical signal proportional to the specular component of the total flux of the reflected light rays.

Another example is U.S. Pat. No. 4,502,778, which discloses digital circuitry and microprocessor techniques to monitor the quality of toner operations in a copier and take appropriate corrective action based upon the monitoring results. Patch sensing is used. Reflectivity signals from the patch and from a clean photoconductor are analog-to-digital converted and a plurality of these signals taken over discrete time periods of a sample are stored. The stored signals are averaged for use in determining appropriate toner replenishment responses and/or machine failure indicators and controls.

U.S. Pat. No. 4,462,680, discloses a toner density control apparatus which assures always the optimum toner supply and good development with toner, irrespective of the kind of original to be copied and/or the number of copies to be continuously made. The apparatus has a detector for detecting the density of toner. The quantity of toner supply is controlled using a value variable at a changing rate different from the changing rate of the density difference between the reference toner density and the detected toner density.

U.S. Pat. No. 4,318,610, discloses an apparatus which controls toner concentration by sampling two test samples. A first test is run with a large toner concentration, wherein a second test has a smaller concentration. Developer mixture concentration is regulated in response to the first test. Photoconductive surface charging is regulated in response to the second test.

U.S. Pat. No. 4,313,671, discloses a method for controlling image density in an electrophotographic copying machine. This method uses two detectors, one measures the toner density of a blank region on a photosensitive member, the second measures a reference toner image closely positioned to the first blank region. The method then compares the two densities and uses this information to control the quantity of toner deposited thereon.

U.S. Pat. No. 4,226,541, discloses illuminating a small area of a surface to be reflectively scanned. This is followed by detecting the intensity of the light reflected from the small area and generating a first signal proportional thereto. The nest step is detecting the intensity of the light reflected from an area at least partially surrounding the small area and generating a second signal proportional thereto. Followed by subtracting at least a fraction of the second signal from the first signal to produce a compensated signal which represents the reflectivity of the small area as compensated for the effects of scattered light. Finally, the process either uses the compensated signal directly as analog data or converting it to a digital output signal having a first state when the compensated signal is above a predetermined threshold and having a second state when the compensated signal is below that threshold.

An ideal goal in electrophotography is to have the correct amount of toner deposited onto a copy sheet on a continuous basis. With poor toner development control two situations occur. First, concerning a variability of toner quantity applied, too little toner creates lighter colors, where too much color toner creates darker colors. Second, concerning the machine, too much toner development causes excess toner waste which both increases the expense of running the machine and wears parts of the machine out sooner. Machines that can achieve precise control of the toner development system will have a tremendous competitive edge.

Typically, the electrophotographic machine, or just machine, utilizes a toner monitoring system. Most commonly, as exemplified by the prior described patents, a densitometer sensor is used to measure the quantity of toner applied in order to establish some feedback and control over the toner development. These machines have been successful to some extent. However, these prior toner monitoring systems have not been responsive to both changing environmental conditions and differences between individual machines. Environmental conditions are defined as, for example, relative humidity, temperature, dirt build-up on the densitometer sensors, and electronic circuit drift. Similarly, differences between individual machines, for example, involves characteristic variability between sensors, static and dynamic variations in mounting distances or angle settings of the sensor, and variability between photoreceptors and similar image bearing members; simply put, no two machines are alike. It is obvious to one skilled in the art, that these factors are responsible for skewing the readings from feedback toner monitoring control systems, which in effect, are directly responsible for regulating the amount of toner deposited on copy sheets.

In response to these problems, a need exists for a more precise toner development monitoring system which accounts for both the changing environmental conditions and the variable characteristics between individual machine components.

As a result, the present invention provides a solution to the described problems and other problems, and also offers other advantages over the prior art.

SUMMARY OF THE INVENTION

A first feature of the invention involves a densitometer capable of receiving electromagnetic energy input and, in response thereto, generating a diffuse component signal and a total flux component signal. This feature has a means for generating, responsive to a first electromagnetic energy input received by the densitometer, a first diffuse component signal and a first total flux component signal. Moreover, there is a means for generating a compensation factor signal, responsive to said first diffuse component signal and said first total flux component signal. Furthermore, there is a means for generating, responsive to a second electromagnetic energy input received by said densitometer, a second diffuse component signal and a second total flux component signal. Finally, there is a means for generating a specular component signal, responsive to said second electromagnetic energy input received by said densitometer, being a function of said second total flux component signal and said second diffuse component signal scaled by said compensation factor signal.

A second feature of the invention involves an electrophotographic machine capable of determining developed toner mass per unit of area on a substrate. This feature has a means for developing at least first and second toner areas on the substrate. Moreover, there is an electromagnetic energy source positioned to direct electromagnetic energy onto said first and second toner areas. Furthermore, there is a densitometer capable of receiving electromagnetic energy input reflected off of said substrate and, in response thereto, generating a diffuse component signal and a total flux component signal. The densitometer has a means for generating, responsive to a first electromagnetic energy input received by said densitometer, a first diffuse component signal and a first total flux component signal. Moreover, the densitometer has a means for generating, responsive to a second electromagnetic energy input received by said densitometer, a second diffuse component signal and a second total flux component signal. Additionally, the feature has a means for generating a compensation factor signal, responsive to said first diffuse component signal and said first total flux component signal. Also, this feature includes a means for generating a specular component signal, responsive to said second electromagnetic energy input received by said densitometer, being a function of said second total flux component signal and said second diffuse component signal scaled by said compensation factor signal. Finally, there is a means for calculating the developed toner mass per unit of area on a substrate, responsive to said specular component signal.

A third feature of the invention involves a method of measuring a material's mass per unit of area located on a substrate. This feature includes a step for depositing a first patch of said material, having a high density, onto the substrate. Moreover, another step generates a compensation ratio, from said first patch, substantially representative of changing environmental conditions. Also, there is a step for depositing a second patch of said material, having a lower density than said first patch, onto said substrate. Finally, there is a step for determining the mass per unit of area of the material from said second patch and said compensation ratio.

BRIEF DESCRIPTION OF THE DRAWINGS

In the drawings, like reference numerals indicate corresponding parts of preferred embodiments of the present invention throughout the several views, in which.

DETAILED DESCRIPTION OF THE PREFERRED EMBODIMENTS

I. Electrophotographic Printing Machine

Figure 1:
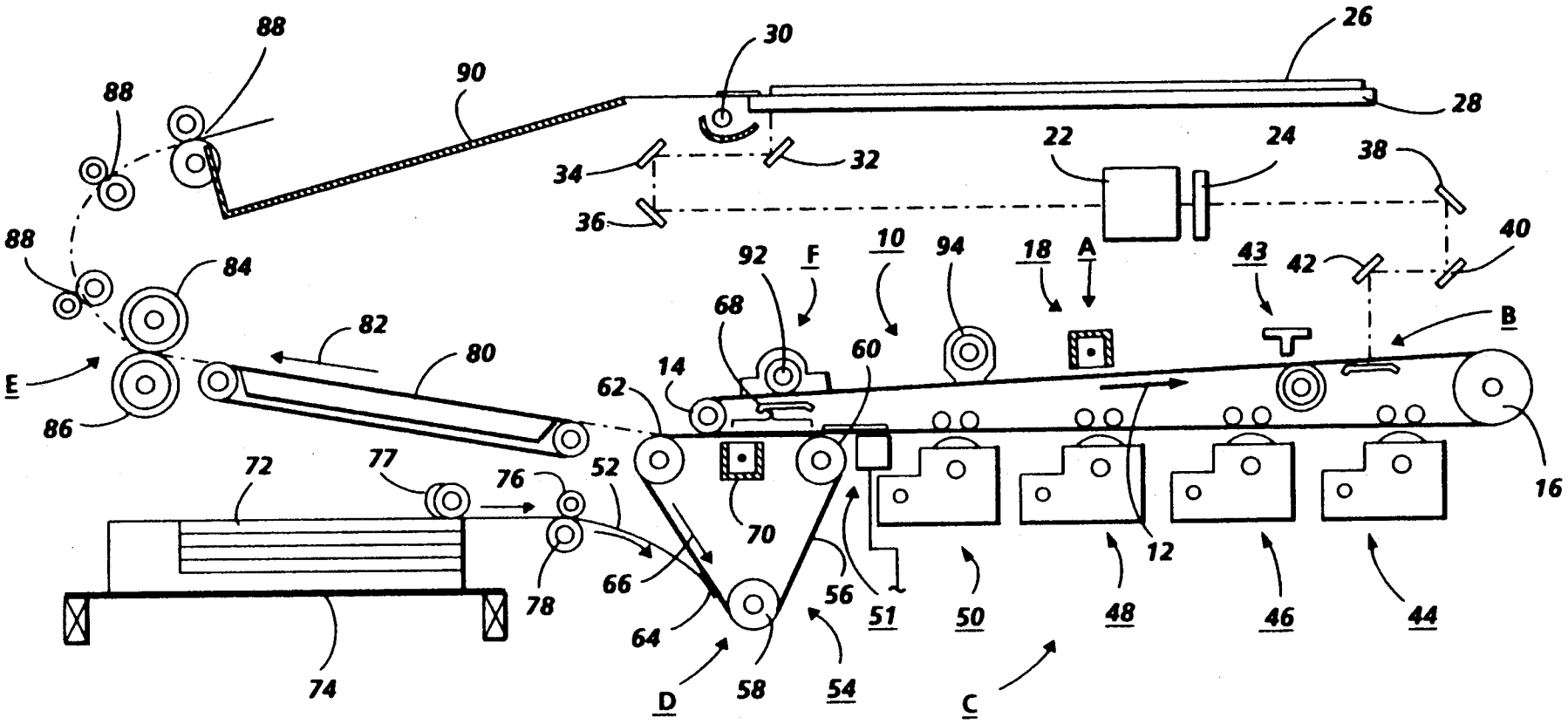
FIG. 1 is an electrophotographic color printing machine.

Although specific terms are used in the following description for the sake of clarity, these terms are intended to refer only to the particular structure of the invention selected for illustration in the drawings, and are not intended to define or limit the scope of the invention.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the infrared densitometer of the present invention therein. It will become evident from the following discussion that the densitometer of the present invention is equally well suited for use in a wide variety of electrophotographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoreceptor, i.e. a photoconductive material coated on a grounding layer, which, in turn, is coated on an anti-curl backing layer. The photoconductive material is made from a transport layer coated on a generator layer. The transport layer transports positive charges from the generator layer. The generator layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about idler roller 14 and drive roller 16. Idler roller 14 is mounted rotatably so as to rotate with belt 10. Drive roller 16 is rotated by a motor coupled thereto by suitable means such as a belt drive. As roller 16 rotates, it advances belt 10 in the direction of arrow 12.

Initially, a portion of photoconductive belt 10 passes through charging station A. At charging station A, a corona generating device, indicated generally by the reference numeral 18, charges photoconductive belt 10 to a relatively high, substantially uniform potential.

Next, the charged photoconductive surface is rotated to exposure station B. Exposure station B includes a moving lens system, generally designated by the reference numeral 22, and a color filter mechanism, shown generally by the reference numeral 24. An original document 26 is supported stationarily upon transparent viewing platen 28. Successive incremental areas of the original document are illuminated by means of a moving lamp assembly, shown generally by the reference numeral 30. Mirrors 32, 34 and 36 reflect the light rays through lens 22. Lens 22 is adapted to scan successive areas of illumination of platen 28. The light rays from lens 22 are transmitted through filter 24 and reflected by mirrors 38, 40 and 42 on to the charged portion of photoconductive belt 10. Lamp assembly 30, mirrors 32, 34 and 36, lens 22, and filter 24 are moved in a timed relationship with respect to the movement of photoconductive belt 10 to produce a flowing light image of the original document on photoconductive belt 10 in a non-distorted manner. During exposure, filter mechanism 24 interposes selected color filters into the optical light path of lens 22. The color filters operate on the light rays passing through the lens to record an electrostatic latent image, i.e. a latent electrostatic charge pattern, on the photoconductive belt corresponding to a specific color of the flowing light image of the original document. Exposure station B also includes a test patch generator, to provide toner test patches, indicated generally by the reference numeral 43, comprising a light source to project a test light image onto the charged portion of the photoconductive surface in the inter-image or inter-document region, i.e. the region between successive electrostatic latent images recorded on photoconductive belt 10, to record a test area. It is noted that the test patch generator is not continuously operated. Toner test patches are only needed intermittently, to monitor the toner development. The test area, as well as the electrostatic latent image recorded on the photoconductive surface of belt 10, are developed with toner, either liquid or powderous, at the development stations (discussed later). A test patch is usually electrostatically charged and developed with toner particles to the maximum degree compatible with the dynamic range of the monitoring sensor so as to monitor as much of the process as practicable. Moreover, a separate test patch for each color toner is generated during operation.

After the electrostatic latent image and test area (or test patch) have been recorded on belt 10, belt 10 advances them to development station C. Station C includes four individual developer units generally indicated by the reference numerals 44, 46, 48 and 50. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the developer material brush into contact with the photoconductive surface. Developer units 44, 46 and 48, respectively, apply toner particles of a specific color, which corresponds to the compliment of the specific color, onto the photoconductive surface. The color of each of the toner particles is adapted to absorb light within a preselected spectral reflection of the electromagnetic wave spectrum corresponding to the wave length of light transmitted through the filter. For example, an electrostatic latent image formed by passing the light image through a green filter will record the red and blue portions of the spectrums as an area of relatively high charge density on photoconductive belt 10. Meanwhile, the green light rays will pass through the filter and cause the charge density on the belt 10 to be reduced to a voltage level insufficient for development. The charged areas are then made visible by having developer unit 44 apply green absorbing (magenta) toner particles onto the electrostatic latent image recorded on photoconductive belt 10. Similarly, a blue separation is developed by developer unit 46, with blue absorbing (yellow) toner particles, while the red separation is developed by developer unit 48 with red absorbing (cyan) toner particles. Developer unit 50 contains black toner particles and may be used to develop the electrostatic latent image formed from a black and white original document. The yellow, magenta and cyan toner particles are diffusely reflecting particles. It is noted that the amount of toner deposited onto the photoconductive belt (or substrate) 10, is a function of the relative bias between the electrostatic image and the toner particles in the developer units. Specifically, a larger relative bias will cause a proportionately larger amount of toner to be attracted to substrate 10 than a smaller relative bias.

Each of the developer units is moved into and out of an operative position. In the operative position, the magnetic brush is closely adjacent to belt 10, while, in the non-operative position, the magnetic brush is sufficiently spaced therefrom. During development of each electrostatic latent image, only one developer unit is in the operative position, the remaining developer units are in the non-operative position. This insures that each electrostatic latent image, and successive test areas, are developed with toner particles of the appropriate color without commingling. In FIG. 1, developer unit 44 is shown in the operative position with developer units 46, 48 and 50 being in the non-operative position. After being developed, a test patch passes beneath a densitometer, indicated generally by the reference numeral 51. Densitometer 51 is positioned adjacent the surface of belt 10. The test patch is illuminated with electromagnetic energy when the test patch is positioned beneath the densitometer. Densitometer 51, generates proportional electrical signals in response to electromagnetic energy, reflected off of the substrate and toner test patch, that was received by the densitometer. In response to the signals, the amount of developed toner mass per unit of area for each of the toner colors can be calculated. It should be noted, that it would be obvious to one skilled in the art to use a variety of electromagnetic energy levels. The detailed structure of densitometer 51 will be described hereinafter with reference to FIGS. 2 through 6, inclusive.

After development, the toner image is moved to transfer station D, where the toner image is transferred to a sheet of support material 52, such as plain paper among others. At transfer station D, the sheet transport apparatus, indicated generally by the reference numeral 54, moves sheet 52 into contact with belt 10. Sheet transport 54 has a pair of spaced belts 56 entrained about three rolls 58, 60 and 62. A gripper 64 extends between belts 56 and moves in unison therewith. Sheet 52 is advanced from a stack of sheets 72 disposed on tray 74. Feed roll 77 advances the uppermost sheet from stack 72 into a nip, defined by forwarding rollers 76 and 78. Forwarding rollers 76 and 78 advance sheet 52 to sheet transport 54. Sheet 52 is advanced by forwarding rollers 76 and 78 in synchronism with the movement of gripper 64. In this way, the leading edge of sheet 52 arrives at a preselected position to be received by the open gripper 64. The gripper 64 then closes securing the sheet thereto for movement therewith in a recirculating path. The leading edge of the sheet is secured releasably by gripper 64. As the belts move in the direction of arrow 66, the sheet 52 moves into contact with belt 10, in synchronism with the toner image developed thereon, at transfer zone 68. Corona generating device 70 sprays ions onto the backside of the sheet so as to charge the sheet to the proper magnitude and polarity for attracting the toner image from photoconductive belt 10 thereto. Sheet 52 remains secured to gripper 64 so as to move in a recirculating path for three cycles. In this way, three different color toner images are transferred to sheet 52 in superimposed registration with one another. Thus, the aforementioned steps of charging, exposing, developing, and transferring are repeated a plurality of cycles to form a multi-color copy of a colored original document.

After the last transfer operation, grippers 64 open and release sheet 52. Conveyor 80 transports sheet 52, in the direction of arrow 82, to fusing station E where the transferred image is permanently fused to sheet 52. Fusing station E includes a heated fuser roll 84 and a pressure roll 86. Sheet 52 passes through a nip defined by fuser roll 84 and pressure roll 86. The toner image contacts fuser roll 84 so as to be affixed to sheet 52. Thereafter, sheet 52 is advanced by forwarding roll pairs 88 to catch tray 90 for subsequent removal therefrom by the machine operator.

The last processing station in the direction of movement of belt 10, as indicated by arrow 12, is cleaning station F. A rotatably mounted fibrous brush 92 is positioned in cleaning station F and maintained in contact with belt 10 to remove residual toner particles remaining after the transfer operation. Thereafter, lamp 94 illuminates belt 10 to remove any residual charge remaining thereon prior to the start of the next successive cycle.

II. Densitometer Background

Figure 2:
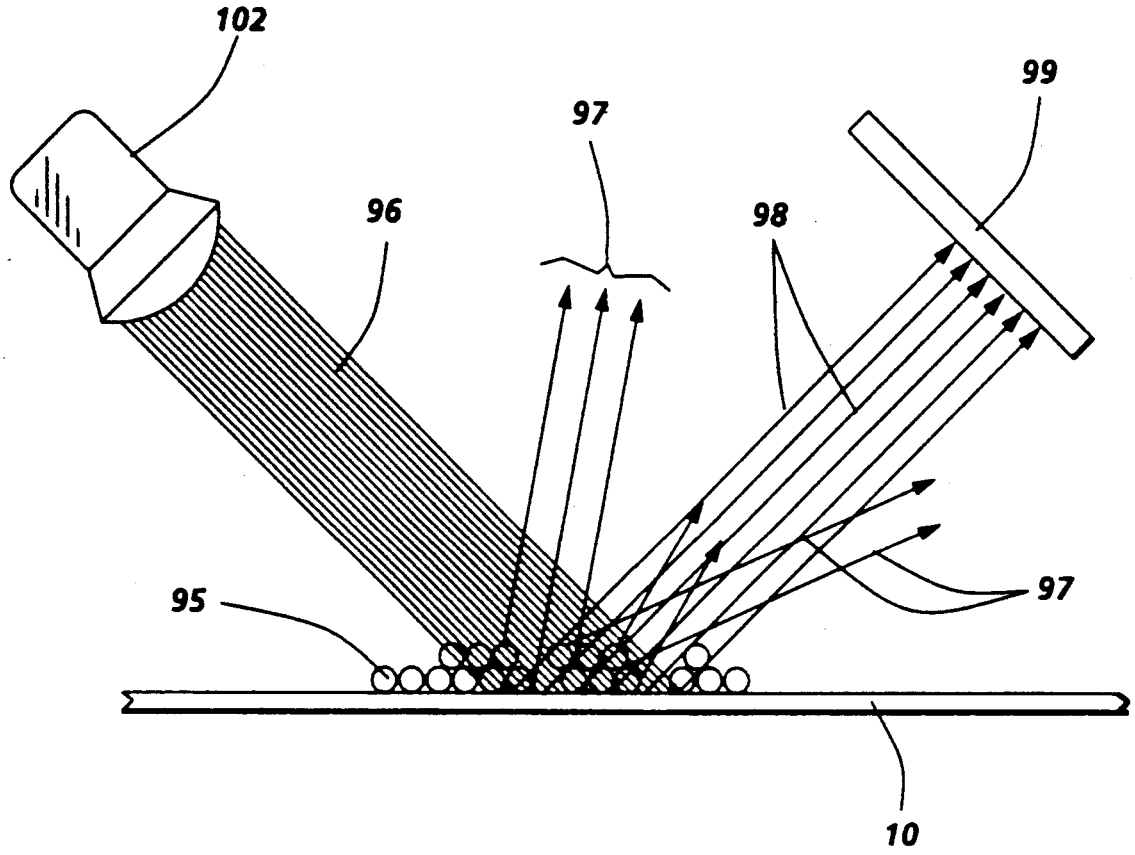
FIG. 2 is a schematic of a simplified densitometer.

Turning to FIG. 2, the following is a review of the principles of operation of a typical toner density sensor. Toner 95 is illuminated with a collimated beam of light 96 from an infrared LED (light emitting diode) 102. It is possible to discuss the interaction of this light beam with the toned photoreceptor sample with three broad categories. A portion of the light reflected by the sample is capture by light receptor 99. There is light that is specularly reflected, generally referred to as specular light component 98, from the substrate or photoreceptor belt 10. This is light that obeys the well known mechanisms of Snell's law from physics; the light impinging upon the surface is reflected at an angle equal to the angle of incidence according to the reflectivity of that surface. For a complex, partially transmissive substrate, the specularly reflected light may result from multiple internal reflections within the body of the substrate as well as from simple front surface reflection. Thus, an appropriately placed sensor will detect the specular light component. However, not all light will be specularly reflect. The second light component, known as diffuse light component 97, is ear to isotropically reflected over all possible angles. The light can be reflected as a result of either single or multiple interactions with both the substrate 10 and toner particles 95. Diffusely reflected light is scattered by a complex array of mechanisms. Finally, there is light that, by whatever mechanism, leaves this system of toned photoreceptor sample and light detector. The light may be absorbed by the toner or the photoreceptor, or be transmitted through the sample to be lost to the system by the mechanisms of absorption or reflection. As a result of toner development onto substrate 10, the intensity of the light specularly reflected 98 from the substrate 10 is increasingly attenuated, yielding a smaller and smaller specular component of light. The attenuation is the result of either absorption of the incident light 96, in the case of black toners, or by scattering of the incident light 96 away from the specular reflection angle, in the case of colored toners. Thus yielding a smaller specular light component being reflected off of substrate 10. It should be noted that it would be obvious to one skilled in the art to modify LED 102 to be most any electromagnetic energy level, and to modify toner 95 to be particles or liquid material.

Figure 3:
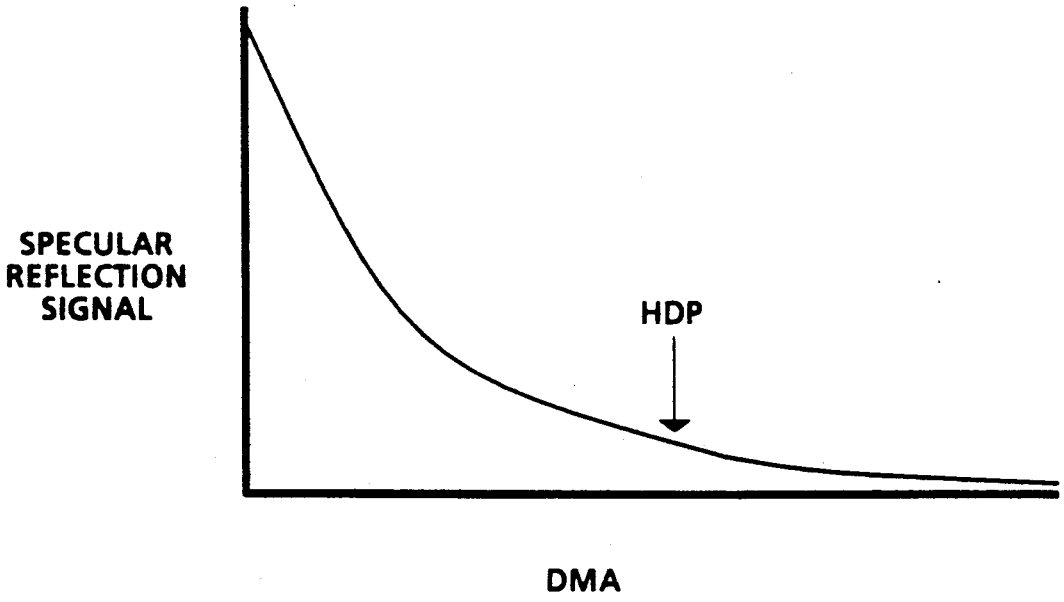
FIG. 3 is a graph showing specular reflection signal versus toner density mass per unit of area.

As shown in FIG. 3, there is a relationship between the DMA and the specular signal detected by the densitometer. At a high DMA quantity, there is only a very small specular signal, at a low DMA quantity, there is a higher specular light signal. One particular point of interest on the graph shows a high density patch (HDP) location. HDP is the threshold DMA concentration required for a complete coverage of substrate 10. In effect, by achieving an HDP a solid picture is achieved on a copy sheet. The requisite DMA for a HDP may be typically around a quantity of 0.78 mg/cm$^2$. The exact value of the DMA is primarily a function of the particle size of the toner and to a minor extent the reflectivity of the underlying substrate. It is found for all cases of interest that as the toner particle size varies, the DMA of the HDP scales in a manner proportional to changes in the maximum DMA required for printing. It is this relationship, as shown in the figure, that has allowed for easy monitoring of DMA concentrations for black toners. Specifically, black toners only allow the sensor to collect light reflected from the substrate since all light contacting the black toner is absorbed. As has been previously described, this absorption is not so for color toners, which creates difficulty in using the same techniques in monitoring color toner concentrations.

Figure 4:
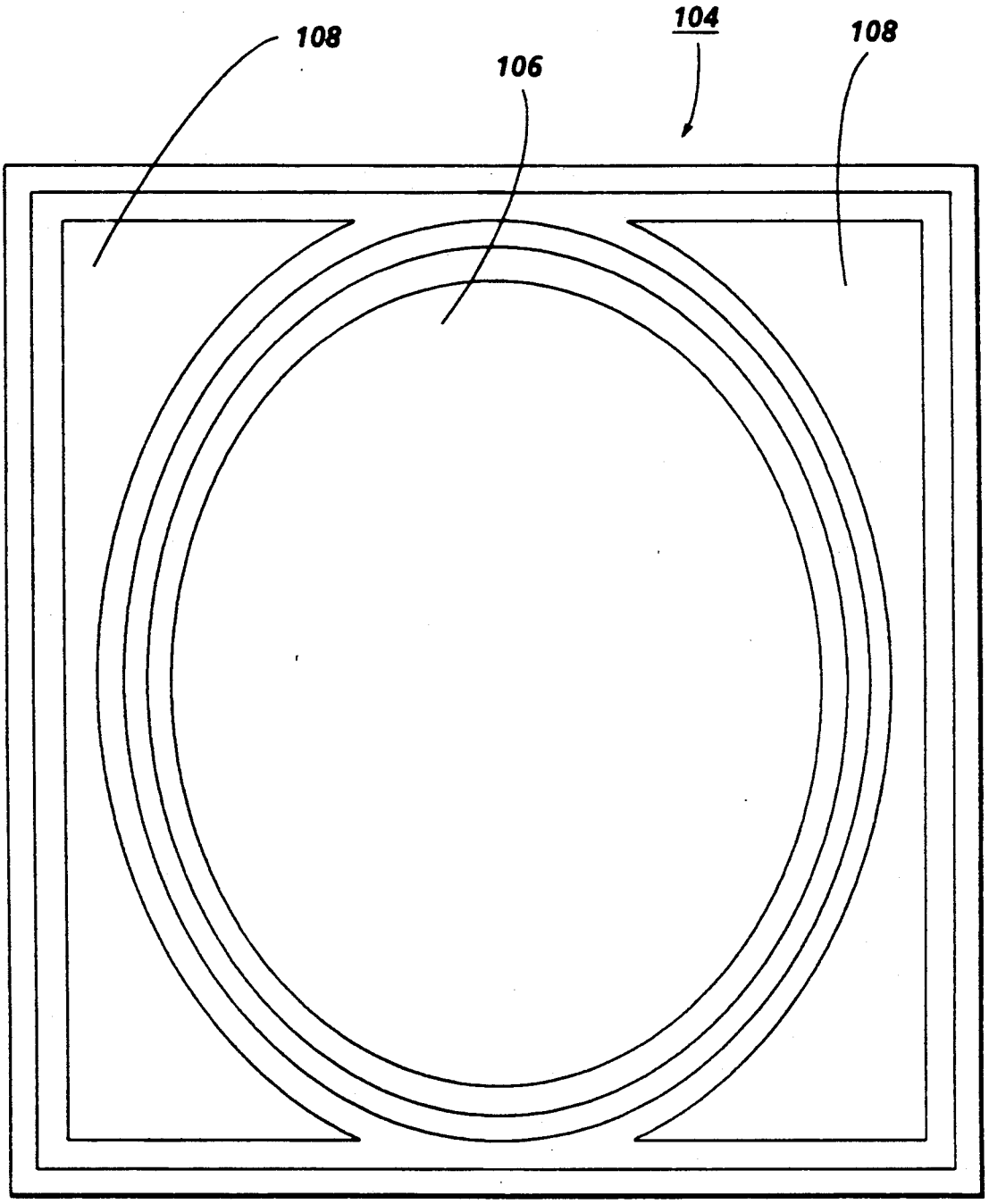
FIG. 4 is a representation of a toner area coverage sensor.

Turning our attention to FIG. 4, there is shown a toner area coverage sensor, generally referred to as sensor 104, which is used in the present invention. Sensor 104 uses a large aperture (not shown) relative to the incident beam spot size, this achieves greater mounting latitude (placement of the sensor in a proper coordinate location and with proper parallelism with respect to the photoreceptor). As a consequence, when used with color toners, central light reflection detector 106 (also referred to as the central detector) collects both specular and diffuse light components, or referred to as the total light flux. At most color toner DMA concentrations, a sensor which only measures total light flux degrades sensitivity and accuracy as a result of the increased percentage of diffusely reflected light which is also collected onto the sensor. Specifically, as described in FIG. 3, the specular light signals which indicate DMA concentrations will now be distorted. To remedy this specular-diffuse mixing situation, sensor 104 has an additional photodiode detector, which collects only the diffusely reflected light component, referred to as periphery detector 108. The advantage of the additional detector arrangement allows for separation of the specular light component from the total flux light component collected by the central detector. Specifically, in operation, the diffuse detector signal, from the diffuse-only detector 108, is subtracted from the total flux detector signal, from central detector 106 which has both specular and diffuse light components. Thus, the true specular signal can be determined. This is based on the assumption that diffusely reflected light is evenly distributed over the whole sensor 104. One such sensor that operates in the above described fashion is previously described co-pending U.S. patent application Ser. No. 07/246,242, which was incorporated by reference. It is noted that other arrangements of sensors will also work; such as an array of small light detectors as provided by a charge-coupled device (CCD) or the like.

III. Densitometer Operation Using A Compensation Factor

Figure 5:
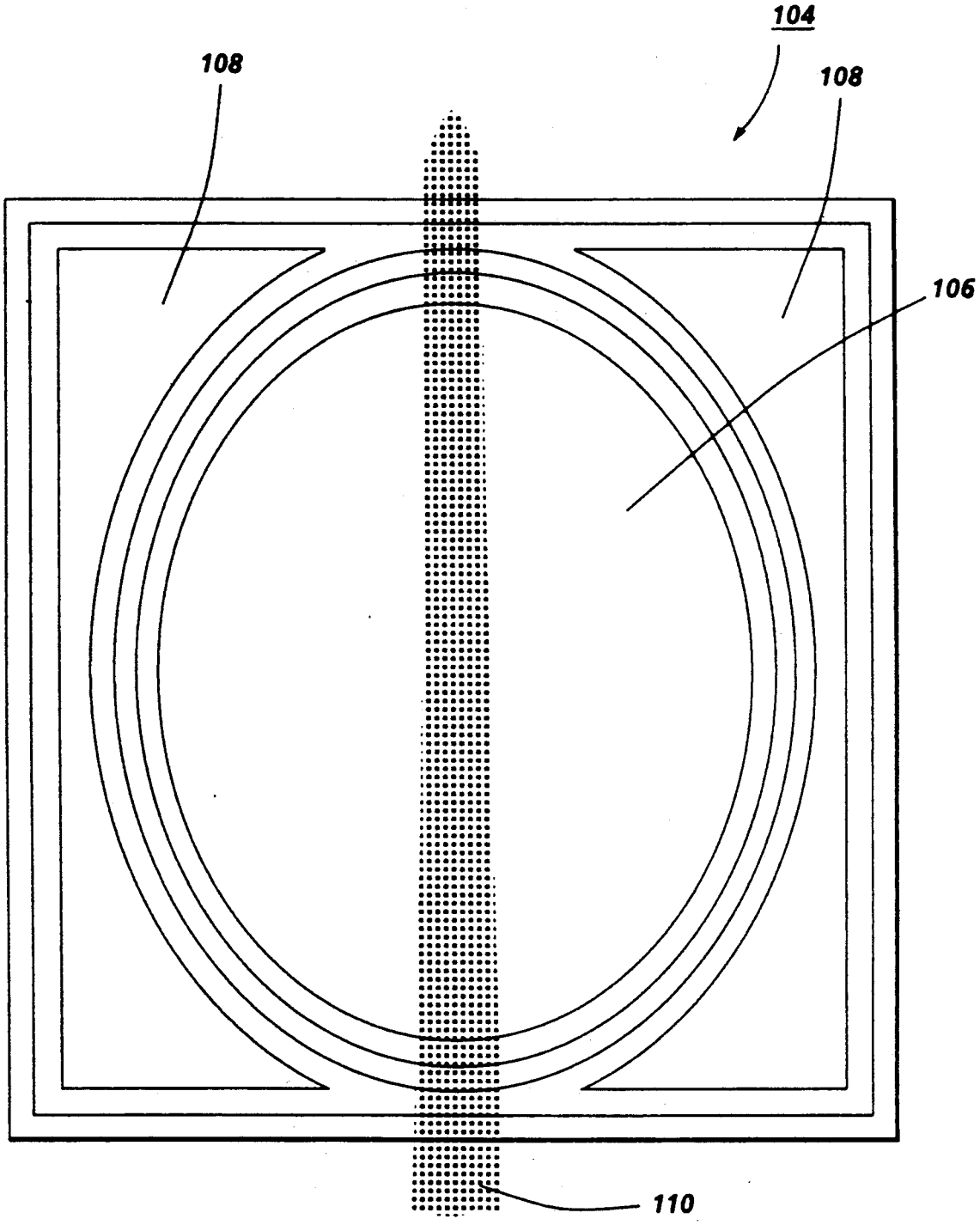
FIG. 5 is a dirt covered toner area coverage sensor.

As has been discussed in the background of the invention, the prior densitometer calculations have not been responsive to both changing environmental conditions and differences between individual machines. As you will recall, for example, dust conditions in and on the densitometer are a changing environmental condition. To one skilled in the art, it is known that dust does not accumulate evenly on all objects; specifically, it has been found that dust can accumulate very unevenly upon lenses of a densitometer. For example, as shown in FIG. 5, dust 110 has been found to accumulate in a line running substantially over detector 106. If a densitometer does not take this environmental condition into account, the wrong DMA concentration will be calculated which will lead to improper adjustment of toner development.

For example, suppose the calculations for this densitometer were as follows:

$$CD-PD=SS$$

Where, CD is the signal from central detector 106 having both specular and diffuse light components, called the total flux; PD is the signal from the periphery detector 108, having only diffuse light components, and SS is the resulting specular signal. There are a few assumptions being made in this formula. First, the areas of the two detectors are corrected to be equal. Second, it is assumed that the diffuse light component is evenly distributed over the entire sensor. As a result of this calculation, signal CD is lower as a result of the environmental dust condition, yet signal PD remains the same (relatively higher). Therefore, a lower SS signal value will be calculated and used to adjust the toner development system to develop with a lower DMA than is required.

Referring to FIGS. 2-5, the current invention has proposed to incorporate a compensation ratio into the calculation. To calculate the compensation ratio, referred to as R in the following formula, the toner development system places on the substrate an HDP with a toner DMA density greater than the minimum value required to reduce the specular signal to a negligible value. As described earlier, a typical minimum value for the DMA would be 0.78 mg/cm$^2$. Next, the HDP is illuminated via a light source. Detector 104 receives the light reflected off of the substrate 10 and HDP and generates two signals. One signal, being a total light flux signal generated by detector 106; the other signal being a diffuse light signal generated by detector 108. A ratio of these two signals, total light flux signal divided by the diffuse light signal, will yield the compensation ratio, R. For example, under typical conditions, as discussed in reference to FIG. 3, DMA concentrations around 0.78 mg/cm$^2$ and greater should result in an insignificant specular light component and a large diffuse light component. Thus, the central detector signal (CD) will only be a diffuse light component, for demonstrating purposes lets call it value x. Moreover, the periphery detector (PD) also is the diffuse light component, having the same value x. By taking a ratio of the two detector signals under ideal conditions the ratio should be equal to one.

$$CD=x$$

$$PD=x$$

$$R=CD/PD=X/X=1$$

Now, under normal conditions, it is understood that the compensation ratio will not be equal to one. The key to the calculations is that ratio R will vary depending upon the changing environmental conditions and differences between individual machines. For example, take the dirt deposit discussed in relation to FIG. 5. Dirt located on the central detector will decrease the signal received by the central detector which is the numerator in the ratio; thus lowering the value of R. A more complete discussion of an application of this variability follows. It is noted that for any DMA concentration over HDP, compensation ratio R will be a constant value.

Once R is calculated, the machine is now ready for standard operation to determine DMA concentrations using the compensation ratio or factor. It is noted that subsequent runs of toner test areas are initiated having a DMA concentration equal to or lower than 0.78 gm/cm$^2$, the HDP concentration range. The use of a lower DMA is important, as discussed over FIG. 3, since both specular and diffuse light components can be sensed by the densitometer. As a result of these toner test runs, the central detector value will be different than the periphery detector value since there is a specular light component added to the central detector. However, and most significantly, the compensation ratio R is incorporated into the compensated calculation as follows:

$$CD-((R)(PD))=SS.$$

Therefore, with this compensated calculation, a true value of the specular signal SS can be more accurately calculated. Referring back to FIG. 5 and the dirt calculation discussion, the R ratio has a value less than one since the central detector was not receiving the full expected value. Similarly, the central detector's signal CD, in the second test run, will also have a lower signal than what it should have under ideal (clean) conditions. Similarly, the periphery detector's signal PD will proportionately be too high in comparison to the degraded central detector signal. However, by using the compensated calculation, PD will be lowered by the compensation ratio value of R (being less than one). Therefore, a true specular signal SS is calculated, and more significantly, the true DMA concentration is accurately identified which allows for proper adjustment of the toner developer of all the toner colors being tested.

One skilled in the art will appreciate that this compensation calculation will work for all of the above described changing environmental conditions and differences between individual machines which are related to the densitometer and marking particle development. This compensation is accomplished since we know that the specular signal is diminished essentially to zero and the ratio R becomes constant for all DMA values greater than the minimum HDP value. Any variation in this expected test will be accounted for in the compensation ratio to adjust the actual specular light component calculation in subsequent test patch runs.

Concerning the timing of the compensated specular signal and the compensation ratio, one skilled in the art will appreciate that there are many variations on when these operations may be executed. For example, the ratio could be calculated once a day when the machine is activated in the morning, or calculated after a certain number of copy sheets have been created, or even every time the toner development system is activated. Moreover, for example, the compensated specular signal could be calculated anywhere from every toner development use (given appropriate circuitry or potentially a second detector arrangement to measure only the HDP developed beside the low density patch), or spacing the calculations out over the use of the machine over an hourly or per count basis.

IV. Densitometer Circuitry

Figure 6:
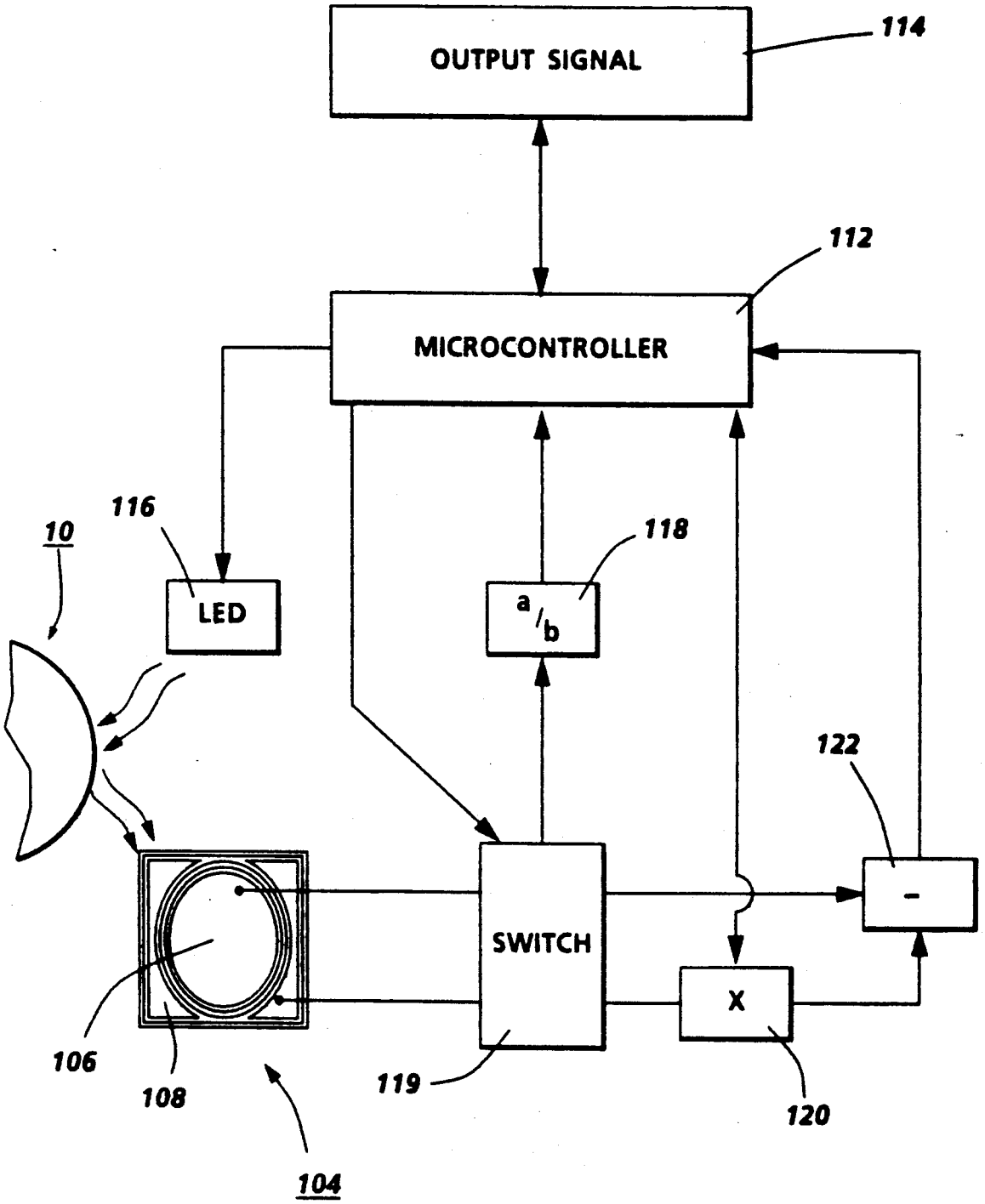
FIG. 6 is an electrical block diagram.

Tuning now to FIG. 6 and referring to the other figs. as well, there is a representation of a potential densitometer electronic circuitry. As shown in FIG. 6, there is a microcontroller 112, output signal 114, LED 116, substrate 10, detector 104, central detector (CD) 106, periphery detector (PD) 108, divider circuitry (a/b) 118, double throw switch 119, multiplication circuitry (×) 120, and a difference circuitry (−) 122. Microcontroller circuitry block 112 represents appropriate circuitry comprising analog to digital circuitry, digital to analog circuitry, ROM and RAM components, bus circuits, and the circuitry for timing of the activation between the components in the microcontroller circuitry and the components connected to the microcontroller circuitry shown in the figure. It is noted that one skilled in the art could design many variations in this circuitry. Similarly, it would be obvious to one skilled in the art to have a significant portion of the above described circuitry to be implemented into a single software program or other processing programs via semiconductors or other devices.

The following is a description of the operation of the whole process of determining a compensated specular signal in relation to the circuitry. First, the toner development system is activated to develop a high density patch (HDP) onto substrate 10. Next, LED 116 is activated when the HDP is positioned to receive the incident light from LED 116. Next, central and periphery detectors 106 and 108 receive reflected light from the toner and substrate 10. Then, there is generation of signals proportional to the total flux (detector 106) and diffuse light (detector 108) components. In response to microcontroller 112, switch 119 directs the signals only to divider circuitry 118 on the HDP DMA concentration test run to generate the compensation ratio/factor. Once the compensation ratio/factor signal is calculated it is sent to microcontroller 112 for storage and ready for use in preceding toner DMA concentration calculations. Next, microcontroller 112 is ready to perform the standard DMA concentration determination tests for various color toners. The first steps are the same as before, except that subsequent toner development test patches are at concentrations below HDP concentrations. Again, detectors 106 and 108 generate proportional signals from the reflected light. Switch 119 is then directing the signals to the remaining circuitry, comprising multiplier 120 and difference 122 circuitry, the divider circuitry is by-passed. Next, the periphery detector signal and the compensation ratio (generated during the compensation factor determination) are sent to multiplication circuitry 120 and multiplied to create a multiplier signal. Next, the multiplier signal and central detector signal are sent to difference circuitry 122 where a compensated specular light component signal is calculated by subtracting the multiplier signal from the central detector signal. This difference signal is sent to microcontroller 112. Finally, microcontroller 112 calculates the DMA concentration from the compensated specular light signal from difference circuitry 122 and comparison to the DMA values know from FIG. 3. Now, appropriate output signals 114 are sent to adjust the electrophotographic machine to achieve proper DMA concentrations ranges.

It is to be understood, however, that even though numerous characteristics and advantages of the present invention have been set forth in the foregoing description, together with details of the structure and function of the invention, the disclosure is illustrative, and changes in matters of order, shape, size, and arrangement of parts may be made within the principles of the invention and to the full extent indicated by the broad general meaning of the terms in which the appended claims are expressed.

What is claimed is:

1. A densitometer capable of receiving electromagnetic energy input and, in response thereto, generating a diffuse component signal and a total flux component signal comprising:

a) means for generating, responsive to a first electromagnetic energy input received by the densitometer, a first diffuse component signal and a first total flux component signal;

b) means for generating a compensation factor signal, responsive to said first diffuse component signal and said first total flux component signal;

c) means for generating, responsive to a second electromagnetic energy input received by said densitometer, a second diffuse component signal and a second total flux component signal; and d) means for generating a specular component signal, responsive to said second electromagnetic energy input received by said densitometer, being a function of said second total flux component signal and said second diffuse component signal scaled by said compensation factor signal.

2. A densitometer according to claim 1, further comprising an array of detectors having a periphery detector portion and a central detector portion, wherein said periphery detector portion creates said first and second diffuse component signals and said central detector portion creates said first and second total flux component signals.

3. A densitometer according to claim 2, wherein said compensation factor signal is substantially equal to said first total flux component signal divided by said first diffuse component signal.

4. A densitometer according to claim 3, further comprising a means for switching from said compensation factor signal generating means to said means for generating a specular component signal once said compensation factor signal is generated.

5. A densitometer according to claim 4 and adapted to work with a substrate having material thereon, further comprising an electromagnetic energy source, having a de-energized and energized state, positioned to direct electromagnetic energy onto the substrate which reflects said electromagnetic energy to said array of detectors.

6. An electrophotographic machine capable of determining developed toner mass per unit of area on a substrate, comprising:

a) means for developing at least first and second toner areas on the substrate;

b) an electromagnetic energy source positioned to direct electromagnetic energy onto said first and second toner areas;

c) a densitometer capable of receiving electromagnetic energy input reflected off of said substrate and, in response thereto, generating a diffuse component signal and a total flux component signal having:

i) means for generating, responsive to a first electromagnetic energy input received by said densitometer, a first diffuse component signal and a first total flux component signal;

ii) means for generating, responsive to a second electromagnetic energy input received by said densitometer, a second diffuse component signal and a second total flux component signal;

d) means for generating a compensation factor signal, responsive to said first diffuse component signal and said first total flux component signal;

e) means for generating a specular component signal, responsive to said second electromagnetic energy input received by said densitometer, being a function of said second total flux component signal and said second diffuse component signal scaled by said compensation factor signal; and f) means for calculating the developed toner mass per unit of area on a substrate, responsive to said specular component signal.

7. An electrophotographic machine according to claim 6, wherein said compensation factor signal is a ratio of said first total flux signal divided by said first diffuse component signal.

8. An electrophotographic machine according to claim 7, further comprising an array of electromagnetic energy detectors having a periphery detector portion and a central detector portion, wherein said periphery detector portion creates said first and second diffuse component signals and said central detector portion creates said first and second total flux signals.

9. An electrophotographic machine according to claim 8, further comprising a switching device that switches from said compensation factor signal generating means to said means for generating a specular component signal once said compensation factor signal is generated.

10. An electrophotographic machine according to claim 9, wherein said first toner area has a concentration sufficient to reduce the specular component signal substantially to zero.

11. An electrophotographic machine according to claim 10, wherein said second toner area has a concentration sufficiently small so that the specular component signal is not substantially reduced to zero.

12. An electrophotographic machine according to claim 11, wherein said electromagnetic energy source, having a de-energized and energized state, positioned to direct electromagnetic energy onto said substrate which reflects said electromagnetic energy to said array of electromagnetic energy detectors.

13. A method of measuring a material's mass per unit of area located on a substrate, including the steps of:

a) depositing a first patch of said material, having a high density, onto the substrate;

b) generating a compensation ratio, from said first patch, substantially representative of changing environmental conditions;

c) depositing a second patch of said material, having a lower density than said first patch, onto said substrate; and d) determining the material's mass per unit of area from said second patch and said compensation ratio.

14. A method of measuring a material's mass per unit of area located on a substrate, as in claim 13, wherein generating a compensation ratio comprises:

a) providing an electromagnetic energy source positioned to direct electromagnetic energy onto said first patch located on said substrate;

b) providing a densitometer capable of receiving electromagnetic energy reflected off of said substrate and said first and second patches;

c) generating a first diffuse component signal and a first total flux component signal, responsive to electromagnetic energy reflected off of said substrate and said first patch and received by said densitometer; and d) determining said compensation ratio to be substantially equal to a compensation signal being a function of said first total flux signal and said first diffuse component signal.

15. A method of measuring a material's mass per unit of area located on a substrate, as in claim 14, wherein said determining the material's mass per unit of area from said second patch and said compensation ratio, comprises:

a) generating a second diffuse component signal and a second total flux component signal, responsive to electromagnetic energy reflected off of said substrate and said second patch and received by said densitometer;

b) generating a specular component signal, responsive to said second total flux component signal and said second diffuse component signal scaled by said compensation signal; and c) calculating said developed toner mass per unit of area on said substrate from said specular component signal.

16. A method of measuring a material's mass per unit of area located on a substrate, as in claim 15, where said providing a densitometer capable of receiving electromagnetic energy reflected off of said substrate and said first and second patches, comprises providing an array of light detectors having a central detector portion and a periphery detector portion, wherein said periphery detector portion creates first and second diffuse component signals and said central detector portion creates said first and second total flux signals.

17. A method of measuring a material's mass per unit of area located on a substrate, as in claim 16, further comprises, providing a switching device that switches from said generating a compensation ratio step to said determining the material's mass per unit of area step once said compensation signal is generated.

18. A method of measuring a material's mass per unit of area located on a substrate, as in claim 17, wherein said first patch of said material, having a high density, comprises a material concentration sufficient to reduce the specular component signal substantially to zero.

19. A method of measuring a material's mass per unit of area located on a substrate, as in claim 18, wherein said second patch of said material, having a lower density than said first patch, comprises a material concentration sufficiently small so that the specular component signal is not substantially reduced to zero.

* * * * *